US005597126A

United States Patent [19]

Frommherz et al.

[11] Patent Number: 5,597,126

[45] Date of Patent: Jan. 28, 1997

[54] STIRRED BALL MILL

[75] Inventors: Harald Frommherz, Rickenbach-Egg, Germany; Albert Leuthold, Oberwil, Switzerland; Marc Weider, Blotzheim, France

[73] Assignee: Willy A. Bachofen, Basel, Switzerland

[21] Appl. No.: 251,901

[22] Filed: Jun. 1, 1994

[30] Foreign Application Priority Data

Jun. 1, 1993 [CH] Switzerland ..... 01632/93

[51] Int. Cl.[6] ..... B02C 17/00

[52] U.S. Cl. ..... 241/172; 241/180

[58] Field of Search ..... 241/172, 180

[56] References Cited

FOREIGN PATENT DOCUMENTS

| | | |
|---|---|---|
| 0129384 | 12/1984 | European Pat. Off. . |
| 1412816 | 10/1964 | France . |
| 737004 | 5/1980 | U.S.S.R. . |
| 1711970 | 2/1992 | U.S.S.R. . |
| 1340385 | 12/1973 | United Kingdom . |
| 2053025 | 2/1981 | United Kingdom . |

*Primary Examiner*—Timothy V. Eley
*Attorney, Agent, or Firm*—Michael J. Striker

[57] ABSTRACT

The continuously operating stirred ball mill used for finely and very finely milling a material has a cylindrical or conical grinding chamber which has a horizontal axis and in which a stirrer rotatable about the chamber axis and intended for moving grinding media present in the grinding chamber is arranged. The known stirred ball mills have the disadvantage that the grinding media are entrained in the direction of the outlet by the material stream passed through from the inlet to the outlet, with the result that said grinding media accumulate in the region of the material outlet and thus lose their grinding effect and adversely influence the milling process. In contrast, the stirrer of the ball mill according to the invention has paddlewheel-like stirring members or propeller-like stirring members formed with separating and guiding disks. The stirring members are formed in such a way that a uniform distribution of the grinding media in the interior space of the grinding chamber is maintained during the milling process, so that disadvantages of the known stirred ball mills can thus be eliminated.

14 Claims, 4 Drawing Sheets

STIRRED BALL MILL

BACKGROUND OF THE INVENTION

The present invention relates to a stirred ball mill and a process for the fine and very fine milling of a material, namely a continuously operating stirred ball mill having a cylindrical or conical grinding chamber for receiving grinding media, a material inlet arranged at one end of the grinding chamber and opening into the interior space of the grinding chamber and a material outlet arranged at the other end of the grinding chamber and leading out of the interior space, and a stirrer which has stirring members, is coaxial with the chamber axis and is intended for moving the grinding media, the stirring members being paddlewheel-like or propeller-like and having a plurality of transport members.

Stirred ball mills are used, for example, for the comminution and dispersing of solids in a liquid phase or for the digestion of microorganisms.

Stirred ball mills which are known on the market and intended for continuous operation have a cylindrical or conical grinding chamber which possesses a horizontal or vertical axis and whose housing is formed from a longitudinal wall and two end walls arranged at the two ends of the longitudinal wall. One end wall has a material inlet which serves for feeding in the mill base and the other end wall has a material outlet which serves for removing the material.

Furthermore, a stirrer which is rotatable about the chamber axis and serves for transporting the grinding media present in the grinding chamber radially relative to the stirrer shaft and thus to comminute, by means of impact and shear forces, the material passed continuously through the grinding chamber, is arranged in the grinding chamber. For this purpose, the stirrers installed in the known stirred ball mills have a plurality of stirring members capable of rotating coaxially with the chamber axis. Said stirring members are, for example, in the shape of a disk having an essentially circular circumference and are divided into tapering prongs extending in the tangential direction by slots extending to the circumference.

During the continuous operation of known stirred ball mills having horizontal and vertical axes, the grinding media are entrained in the direction of the material outlet by the stream of the material to be milled, with the result that the grinding media accumulate in the region of the material outlet and lose their milling and dispersing effect because they are no longer moved by the stirring members of the stirrer. The grinding media accumulating in the region of the material outlet during the milling and dispersing process hinder the continuous discharge of the product stream, resulting in an increase in the internal pressure of the chamber. This increase in the internal pressure of the chamber finally results in the grinding media and also the stirring members being subjected to relatively severe mechanical wear during the milling and/or dispersing process and in the necessity of increasing the stirring power required to move the stirring members in order to maintain a product stream flowing uniformly out of the grinding chamber. The accumulation of grinding media in the region of the material outlet furthermore results in an increase in the grinding temperature, which may also have an adverse effect on the quality of the product to be produced.

SUMMARY OF THE INVENTION

It is an object of the invention to provide a stirred ball mill which does not have the disadvantages of the known stirred ball mills and in particular permits gentle and uniform milling of a material.

This object is achieved by a stirred ball mill having a cylindrical or conical grinding chamber for receiving grinding media, a material inlet arranged at one end of the grinding chamber and opening into the interior space of the grinding chamber and a material outlet arranged at the other end of the grinding chamber and leading out of the interior space, and a stirrer which has stirring members, is coaxial with the chamber axis and is intended for moving the grinding media, the stirring members being paddlewheel-like or propeller-like and having a plurality of transport members, wherein a circular disk is arranged on each of the two sides of the transport members, wherein at least one of the two disks has at least one central orifice through which the mixture formed from the grinding media and the material to be milled can flow, and wherein the stirring members are formed and dimensioned so that, during operation of the stirred ball mill, a part of the mixture flows back continuously over the edge of the disk having the central orifice, radially inward toward the central orifice, and from there into the intermediate space between the disks, and wherein a uniform axial distribution of the grinding media in the interior space of the grinding chamber is thus maintained.

It is also another feature of the present invention to provide a method of finely and very finely milling a material in a stirred ball mill in accordance with which the stirring members are rotated in direction which results in a radial movement of the grinding media outwards, wherein the velocity with which the grinding media are moved radially is greater than the velocity with which the material to be milled is passed through the grinding chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
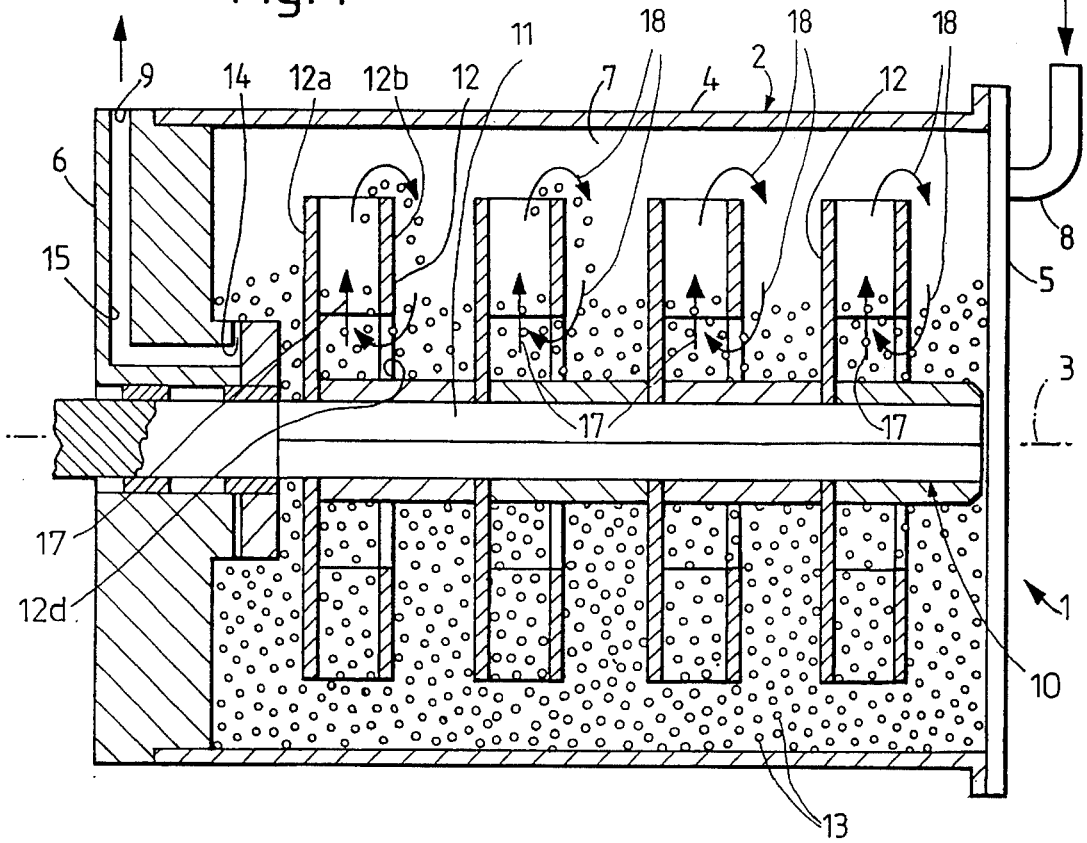
FIG. 1 shows a longitudinal section through a part of a cylindrical grinding chamber.

The grinding chamber of a stirred ball mill, which chamber is shown only in part in FIG. 1 and is denoted as a whole by 1, has a housing 2 having a horizontal axis 3. The housing 2 has an elongated, essentially cylindrical longitudinal wall 4 and two end walls 5 and 6 which are arranged at both ends of the longitudinal wall 4 and of which end wall 5 has a material inlet 8 which serves for feeding in the mill base and end wall 6 has a material outlet 9 which serves for removing the material.

Furthermore, a stirrer 10 which has four paddlewheel-like stirring members 12 distributed along the axis 3 and can be rotated by a drive means not shown in the drawing is arranged in the interior space 7. The shaft 11 of the stirrer 10 is coaxial with the axis 3 and is fastened to the drive means at its end which passes through end wall 6.

Figure 2:
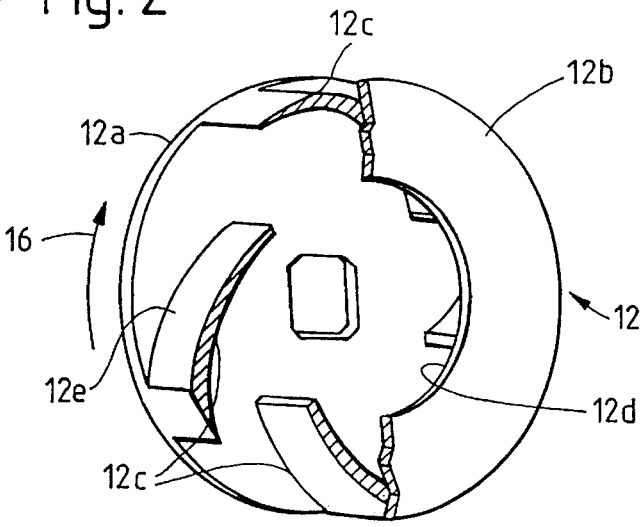
FIG. 2 shows a plan view of a stirring organ represented in FIG. 1.

As is evident from FIGS. 1 and 2, each stirring member 12 has a disk 12*a* facing the end wall 6, an annular disk 12*b* arranged parallel to the disk 12*a*, facing the end wall 5 and having an orifice 12*d* coaxial with the axis 3, and a plurality of transport members which connect the two disks 12*a* and 12*b* to one another and are in the form of paddles 12*c*. Said transport elements are arc-shaped in the longitudinal section and connect the disks 12*a* and 12*b* to one another.

Finally, a separation mechanism which is connected to the outlet 9 via an outlet pipe 15 and in this case is in the form of annular gap 14 and which is dimensioned so that the milled material can flow out of the interior space 7 but the grinding media 13 used for milling are retained is present in the end wall 6 of the grinding chamber 1.

During operation of a stirred ball mill having the grinding chamber 1, a material to be milled or to be dispersed in a liquid is transported in fluid form through the inlet 8 continuously into the interior space 7 of the grinding chamber 1 and conveyed therein to outlet 9. These may be, for example, dye suspensions, paints, printing inks, agrochemicals, filler suspensions, video tape coating materials, cosmetics, foods or microorganisms. During the operation of the stirred ball mill, the grinding media present in the interior space 7 of grinding chamber 1 mill and/or disperse the material passed continuously through the grinding chamber 1, after which the product produced in the grinding chamber leaves the latter—in a continuously fluid stream—through the separation mechanism 14.

The stirring members 12 which rotate in the direction indicated by the arrow 16 during the milling and/or dispersing process are formed and dimensioned so that a part of the mixture formed from the grinding media 13 and the material to be milled and/or dispersed is transported continuously, radially outward in the direction indicated by the arrow 17, after which at least a part of the mixture flows, in the direction indicated by the arrow 18, to the orifice 12*d* and from there back into the intermediate space between the two disks 12*a* and 12*b* or is sucked into said intermediate space. As a result of this, and because the velocity with which the stated mixture is moved radially is preferably greater than the velocity of the material passed through the grinding chamber 1—with the result that entrainment of grinding media 13 by the material flowing through axially is avoided—a uniform distribution of the grinding media 13 may result in the interior space 7. The velocity with which the grinding media 13 are moved radially may be, for example, a factor of about three to seven greater than the velocity with which the material to be milled flows through the grinding chamber 1.

The grinding chamber shown in FIGS. 3 and 5 and denoted as a whole by 21 is formed similarly to the grinding chamber 1 described with reference to FIG. 1 and, like this, has a housing 22, formed from a longitudinal wall 23 and two end walls 24 and 25, and a horizontally positioned stirrer 26.

Figure 3:
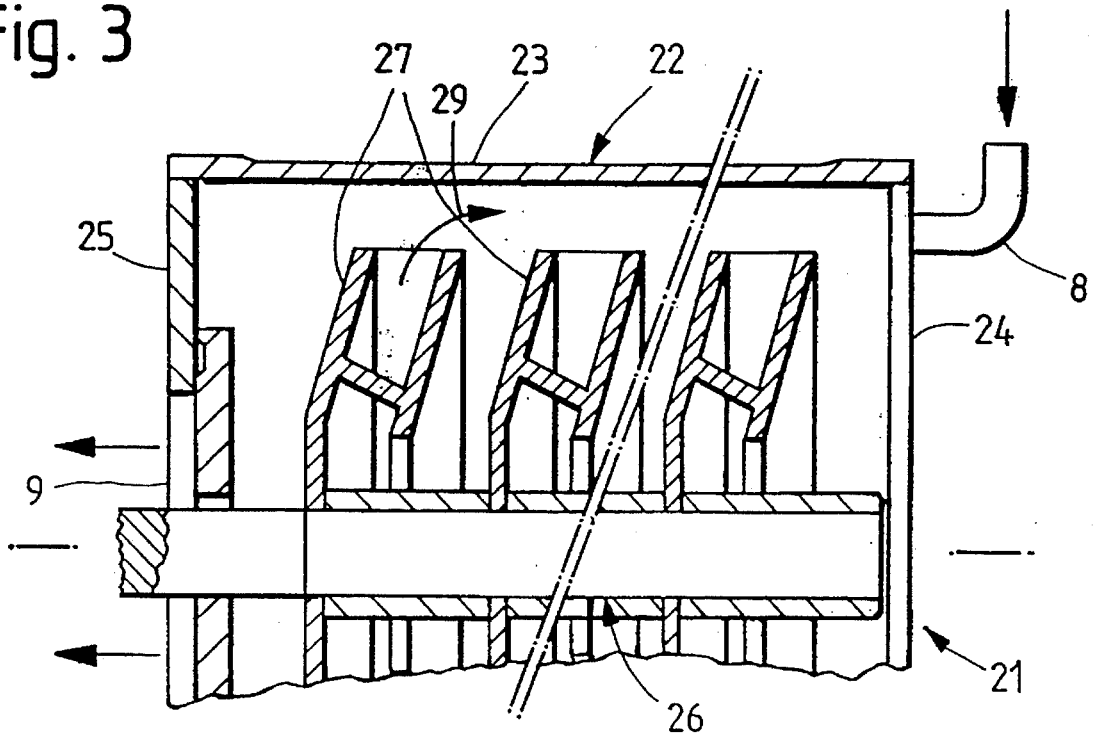
FIG. 3 shows a longitudinal section through a second grinding chamber.
Figure 4:
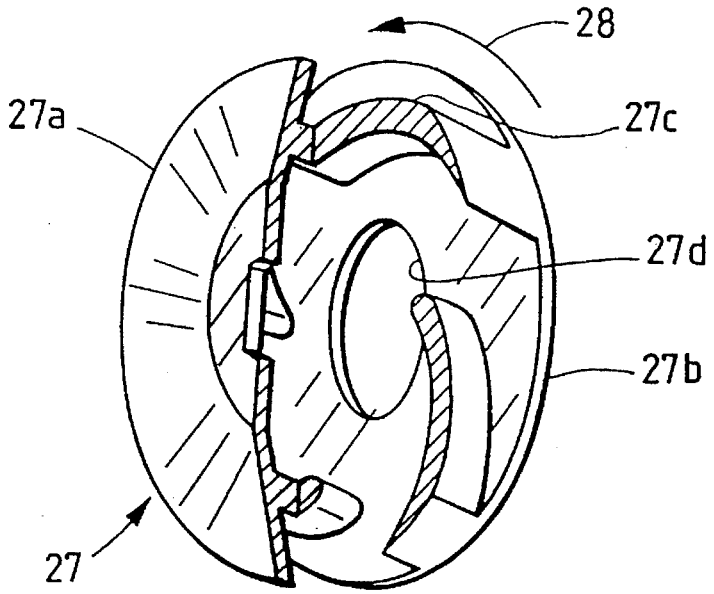
FIG. 4 shows a plan view of a stirring organ represented in FIG. 3.

In FIG. 3, the stirrer 26 has a plurality of paddlewheel-like stirring members 27, each of which consists of an essentially circular disk 27*a*, a disk 27*b* arranged parallel thereto and a plurality of paddles 27*c* arranged between the disks 27*a* and 27*b*. The stirring member 27 shown in FIG. 4 differs from the stirring member 12 in that the disks 27*a* and 27*b* slope toward end wall 24 and in that the disk 27*b* facing the material inlet 8 has the central orifice 27*d* so that, during operation of the stirred ball mill, the mixture to be moved radially by the stirring members is sucked in on that side of the stirring members 27 which faces end wall 24. The curved shape of the stirring members 27 has the additional advantage that, during rotation of the stirring members 27 in the direction indicated by the arrow 28, the grinding media sucked through the hole 27*d* are ejected from the stirring member 27 in the direction of the arrow 29, i.e. in the direction opposite to the direction of flow of the material, so that consequently a uniform distribution of the grinding media 13 in the interior space 7 may result even in the case of a relatively high axial velocity of the material to be milled and/or to be dispersed in a liquid.

Figure 5:
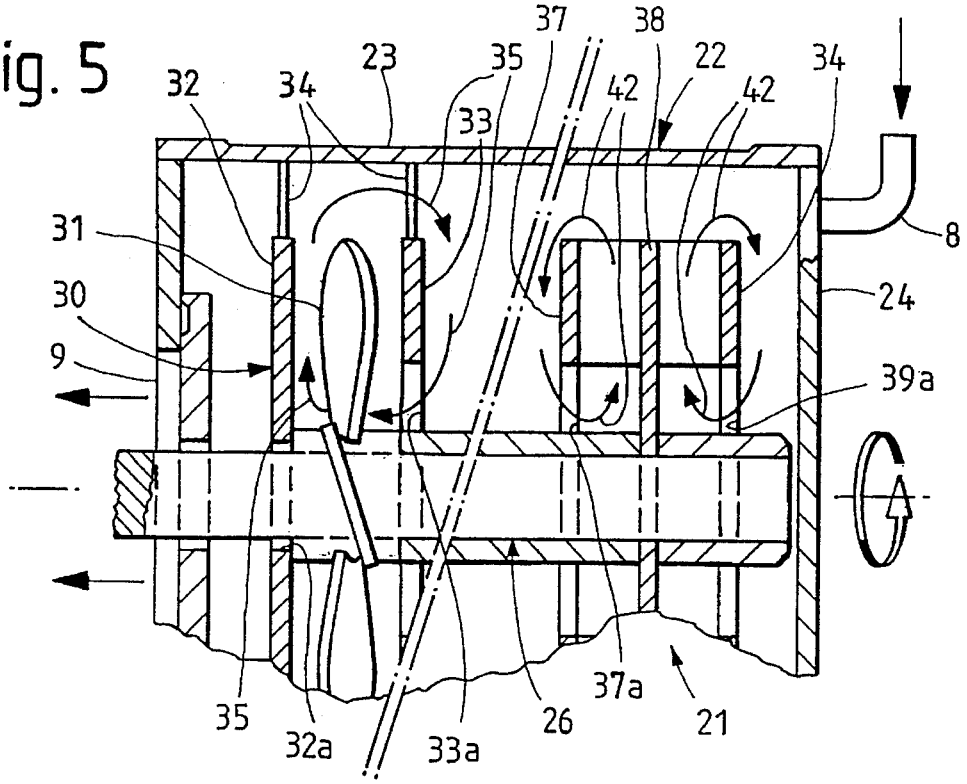
FIG. 5 shows a longitudinal section through a third grinding chamber.

In FIG. 5, the stirrer 26 has two different stirring members, namely a propeller-like stirring member 31 and a paddlewheel-like stirring member 36.

Figure 6:
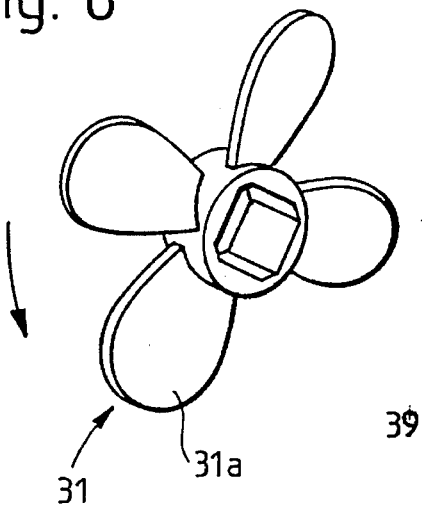
FIG. 6 shows a plan view of a part of a stirring member represented in FIG. 5.

The stirring member 30 is composed of a propeller 31 and two circular disks 32 and 33. The latter are fastened to the inner wall of the grinding chamber 21 by means of retaining arms 34, and each has a hole 32*a* and 33*a* which is coaxial with the chamber axis and through which the shaft of the stirrer 26 passes. The propeller 31 shown in FIG. 6 has four blades 31*a* which are in the form of transport members and by means of which, during the operation of the stirred ball mill, the mixture placed in the grinding chamber is transported to the disk 32. In the embodiment shown in FIG. 5, the diameter of the hole 33*a* of the disk 33 facing the material inlet is preferably greater than the diameter of the drive shaft, for example twice as large as the latter, so that, during operation of the stirred ball mill, at least a part of the mixture transported to the wall 32 by the propeller is continuously deflected radially and can flow back again, in the direction of the arrow 35, into the intermediate space between the two disks 32 and 33.

It should also be noted here that the stirring member 30 can be modified in various respects. Thus, at least one of the two disks 32 and 33 can be alternatively fastened to the shaft of the stirrer 26 instead of being fastened to the inner wall of the grinding chamber 21. A disk which serves for sucking in the mixture placed in the grinding chamber 21 and which is fastened without retaining arms 34 has at least one central hole or a plurality of individual holes arranged, for example, in circular fashion, in contrast to the disk 33 shown in FIG. 5. Furthermore, it is also possible to combine with one another a plurality of propeller-like stirring members whose propellers generate transport directions which are opposite to one another.

Figure 7:
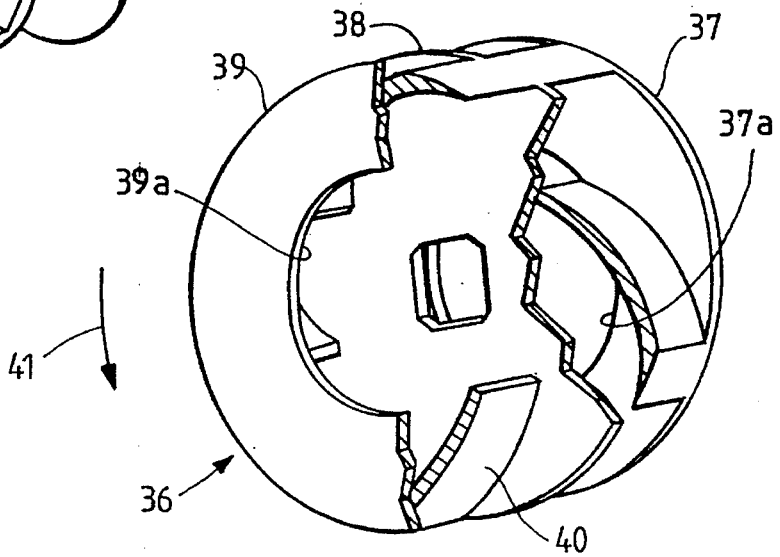
FIG. 7 shows a plan view of another stirring member represented in FIG. 5 and FIGS. 8 and 9 show a plan view of two further embodiments of a stirring member.

The paddlewheel-like stirring member 36 shown in FIG. 7 differs from the stirring members 12 and 27 in that it has three disks 37, 38 and 39 arranged parallel to one another, in that the paddles 40 are arranged between every two disks, namely between the disks 37 and 38 and the disks 38 and 39, in that the two outer disks 37 and 39 each have a central orifice 37*a* and 39*a*, respectively, and in that the stirring member 36 is fastened to the shaft of the stirrer 26 by means of the middle disk 38.

During the milling and/or dispersing process, the stirring member 36 rotates in the direction of the arrow 41, so that a part of the mixture formed from the grinding media and the material to be milled and/or to be dispersed is continuously sucked through the two holes 37*a* and 39*a*, transported radially outward by the paddles 40 and transported radially inward again over the edges of the disks 37 and 39, so that, as a result, the circulation indicated by the arrow 42 is established on both sides of the stirring member 36.

Figure 8:
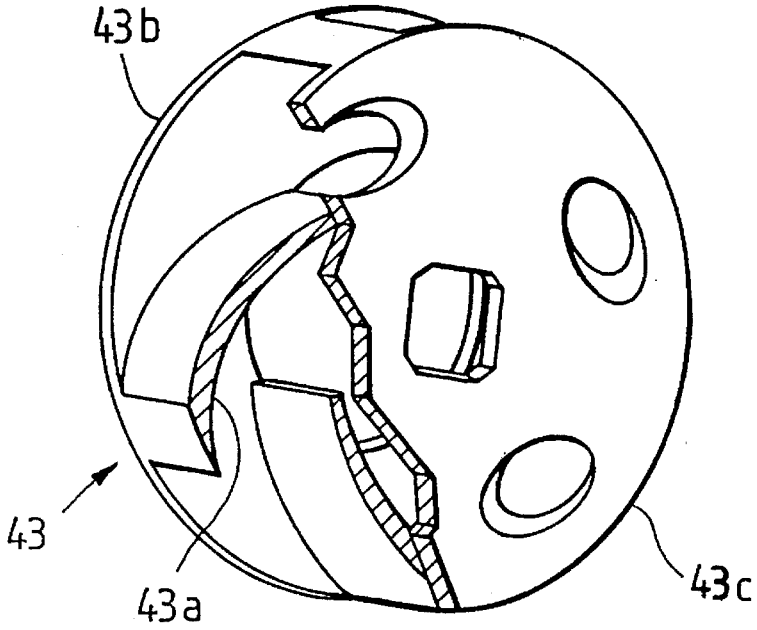
Figure 9:
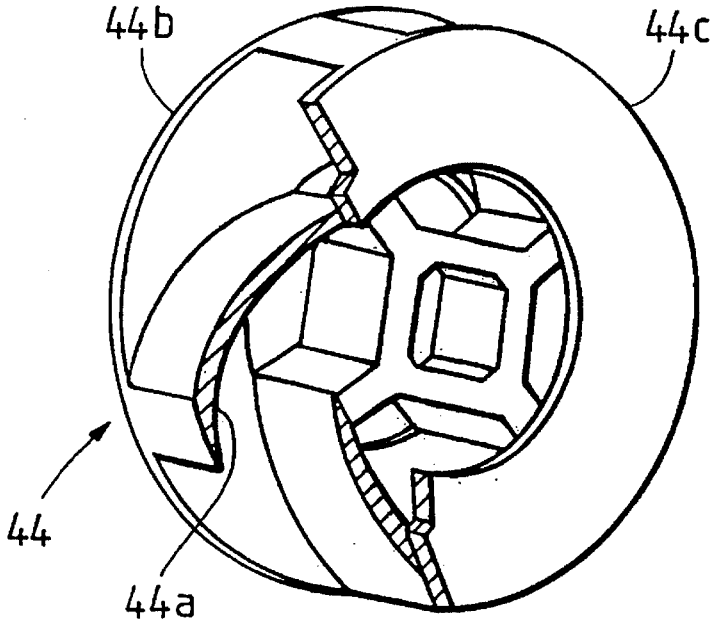

Two further embodiments of stirring members which serve the same purpose as the stirring members 12, 27, 30 and 36 described above are shown in FIGS. 8 and 9. The paddlewheel-like stirring members 43 and 44 shown in these Figures have essentially the same form as the stirring member 12 shown in FIGS. 1 and 2 but differ therefrom in that the disks 43*b* and 43*c* or 44*b* and 44*c* arranged on both sides of the paddles 43*a* and 44*a*, respectively, each have at least one hole, so that, during the milling and/or dispersing process, the mixture present in the interior space of the grinding chamber is sucked in on both sides, transported radially outward by the paddles 43*a* or 44*a*, transported radially inward over the edges of the two disks and then transported once again into the intermediate space between the two disks 43*b* and 43*c* or 44*b* and 44*c*.

Compared with the known stirred ball mills, the stirred ball mill according to the invention has the advantage that a uniform distribution of the grinding media in the grinding chamber, which is not compacted toward the outlet, is maintained during the entire milling and/or dispersing process, and that as a result a pressure and temperature increase in the region of the material outlet, which is disadvantageous for the preparation of the product, and increased wear of the apparatus can be substantially avoided.

It should be pointed out here that the grinding chambers and stirring members described with reference to FIGS. 1 to 7 represent only a selection of a plurality of possible embodiments of the invention and may be modified in various respects.

Thus, for example, the stirring members described above may be combined with one another or with other stirring members in any manner.

Furthermore, for example, the outer surfaces 12*e* of the paddles 12*c* shown in FIGS. 1 and 2, which surfaces face away from the axis 3, may form an acute angle with the inner surface of the disk 12*b*, so that the grinding media 13 moved by the stirring member 12 are ejected in a direction opposite to the direction of flow of the material—in a manner similar to that for the stirring member 27.

Finally, the longitudinal wall of the grinding chamber may additionally be surrounded by a cylindrical jacket which, together with said chamber, bounds an intermediate space which has a circular cross-section and into which a cooling or heating fluid can be passed for cooling or heating the material present in the interior space.

It will be understood that each of the elements described above, or two or more together, may also find a useful application in other types of constructions and methods differing from the types described above.

While the invention has been illustrated and described as embodied in a stirred ball mill and method of milling, it is not intended to be limited to the details shown, since various modifications and structural changes may be made without departing in any way from the spirit of the present invention.

Without further analysis, the foregoing will fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A continuously operating stirred ball mill for fine and very fine milling of a material, comprising a grinding chamber for receiving grinding media; a material inlet arranged at one end of said grinding chamber and opening into an interior space of said grinding chamber; a material outlet arranged at another end of said grinding chamber and leading out of the interior space of said grinding chamber; a stirrer provided with stirring members, said stirrer being arranged coaxially with an axis of said grinding chamber and being operative for moving the grinding media, each of said stirring members consisting of two circular discs and a get of transport members located axially between said two circular discs and connecting said two circular discs with one another so, that said stirrer is free of additional circular discs between said stirring members, at least one of said two circular disks having at least one central orifice through which a mixture formed from the grinding media and a material to be milled can flow, said stirring members being formed and dimensioned so that during operation of the stirred ball mill, a part of the mixture flows back continuously over an edge of said at least one disk having said central orifice, radially inward toward said central orifice, and from there into an intermediate space between said two circular disks, so as to maintain uniform axial distribution of the grinding media in said interior space of said grinding chamber.

2. A continuously operated stirred ball mill as defined in claim 1, wherein said grinding chamber is cylindrical.

3. A continuously operated stirred ball mill as defined in claim 1, wherein said grinding chamber is conical.

4. A continuously operated stirred ball mill as defined in claim 1, wherein said stirring members are paddlewheel members.

5. A continuously operated stirred ball mill as defined in claim 1, wherein said stirring members are propeller members.

6. A continuously operated stirred ball mill as defined in claim 1, wherein said two circular disks are arranged perpendicular to said axis of said grinding chamber.

7. A continuously operated stirred ball mill as defined in claim 1, wherein said at least one disk having said central orifice faces said material inlet.

8. A continuously operated stirred ball mill as defined in claim 1, wherein the other of said two disks also has a central orifice.

9. A continuously operating stirred ball mill for fine and very fine milling of a material, comprising a grinding chamber for receiving grinding media; a material inlet arranged at one end of said grinding chamber and opening into an interior space of said grinding chamber; a material outlet arranged at another end of said grinding chamber and leading out of the interior space of said grinding chamber; a stirrer provided with stirring members, said stirrer being arranged coaxially with an axis of said grinding chamber and being operative for moving the grinding media, said stirring members having a plurality of transport members; circular disks each arranged on a respective one of two sides of said transport members, at least one of said two circular disks having at least one central orifice through which a mixture formed from the grinding media and a material to be milled can flow, said stirring members being formed and dimensioned so that during operation of the stirred ball mill, a part of the mixture flows back continuously over an edge of said at least one disk having said central orifice, radially inward toward said central orifice, and from there into an intermediate space between said two circular disks, so as to maintain uniform axial distribution of the grinding media in said interior space of said grinding chamber, said stirrer having a plurality of paddles which are arc-shaped in a longitudinal section, said paddles extend tangentially to the edge of said at least one disk and, together with said two disks, form an integral member.

10. A continuously operated stirred ball mill as defined in claim 9, wherein said paddles are perpendicular to said two disks.

11. A continuously operated stirred ball mill as defined in claim 9, wherein said paddles have an outer surface which faces away from said axis of said grinding chamber and makes an acute angle with an inner surface of a corresponding one of said disks which faces said material inlet.

12. A continuously operating stirred ball mill for fine and very fine milling of a material, comprising a grinding chamber for receiving grinding media; a material inlet arranged at one end of said grinding chamber and opening into an interior space of said grinding chamber; a material outlet arranged at another end of said grinding chamber and leading out of the interior space of said grinding chamber; a stirrer provided with stirring members, said stirrer being arranged coaxially with an axis of said grinding chamber and being operative for moving the grinding media, said stirring members having a plurality of transport members; circular disks each arranged on a respective one of two sides of said transport members, at least one of said two circular disks having at least one central orifice through which a mixture formed from the grinding media and a material to be milled can flow, said stirring members being formed and dimensioned so that during operation of the stirred ball mill, a part of the mixture flows back continuously over an edge of said at least one disk having said central orifice, radially inward toward said central orifice, and from there into an intermediate space between said two circular disks, so as to maintain uniform axial distribution of the grinding media in said interior space of said grinding chamber, said stirrer having at least three disks and a plurality of paddles which are arc-shaped in a longitudinal section and extend tangentially to edges of said disks, said paddles being arranged between every two of said disks, each of two outer ones of said disks having said central orifice.

13. A continuously operating stirred ball mill for fine and very fine milling of a material, comprising a grinding chamber for receiving grinding media; a material inlet arranged at one end of said grinding chamber and opening into an interior space of said grinding chamber; a material outlet arranged at another end of said grinding chamber and leading out of the interior space of said grinding chamber; a stirrer provided with stirring members, said stirrer being arranged coaxially with an axis of said grinding chamber and being operative for moving the grinding media, said stirring members having a plurality of transport members; circular disks each arranged on a respective one of two sides of said transport members, at least one of said two circular disks having at least one central orifice through which a mixture formed from the grinding media and a material to be milled can flow, said stirring members being formed and dimensioned so that during operation of the stirred ball mill, a part of the mixture flows back continuously over an edge of said at least one disk having said central orifice, radially inward toward said central orifice, and from there into an intermediate space between said two circular disks, so as to maintain uniform axial distribution of the grinding media in said interior space of said grinding chamber, said stirrer having a shaft, each of said disks having a hole which is coaxial with said axis of said grinding chamber and through which said shaft of said stirrer passes, one of said disks being fastened to an inner wall of said grinding chamber while another of said discs is fastened to said shaft.

14. A continuously operated stirred ball mill as defined in claim 13; and further comprising means for fastening said disks and including retaining arms.

* * * * *